United States Patent [19]

Behr

[11] 4,121,645

[45] Oct. 24, 1978

[54] ROOM DIVIDER PANEL ASSEMBLY

[76] Inventor: Joseph Henry Behr, 4000 deMaisonneuve, Westmount, Quebec, Canada, H3Z 1J9

[21] Appl. No.: 794,373

[22] Filed: May 6, 1977

[51] Int. Cl.[2] ..... A47G 5/00

[52] U.S. Cl. ..... 160/135; 160/351

[58] Field of Search ..... 160/135, 351; 52/239, 52/282

[56] References Cited

U.S. PATENT DOCUMENTS

| | | | |
|---|---|---|---|
| 2,323,699 | 7/1943 | Babros | 160/135 X |
| 3,289,368 | 12/1966 | Mark | 52/239 X |
| 3,428,108 | 2/1969 | Singer | 160/135 |
| 3,713,474 | 1/1973 | Orlando | 160/351 |
| 3,768,222 | 10/1973 | Birum, Jr. | 160/135 X |
| 3,817,396 | 6/1974 | Markson | 160/135 X |
| 3,841,042 | 10/1974 | Siegal | 52/239 |
| 3,949,827 | 4/1976 | Witherspoon | 52/239 X |

FOREIGN PATENT DOCUMENTS

| | | | |
|---|---|---|---|
| 1,313,182 | 11/1962 | France | 160/135 |

*Primary Examiner*—Philip C. Kannan

*Attorney, Agent, or Firm*—Larson, Taylor and Hinds

[57] ABSTRACT

A room divider panel unit is disclosed having a load bearing rectangular frame and more flexible interlocking connections between units than present day room dividers. The load bearing rectangular frame has a horizontal top member, horizontal bottom member and two vertical side members, all members formed from a common cross section of hollow double channel press formed sheet steel rigidly joined together. Two vertical caps of semi-circular cross section are attached to the edges of the vertical side members, extending from top to bottom. Lock connecting means are located at the semi-circular center of the two vertical caps at the top and bottom, and the unit is supported by a pair of legs.

11 Claims, 11 Drawing Figures

ROOM DIVIDER PANEL ASSEMBLY

The present invention relates to acoustical screens and room dividers independent from building structures. More particularly the present invention relates to a self-standing interchangeable room divider panel assembly having at least two units with connecting links therebetween especially designed for office landscaping.

In many office buildings today, it has become economical and functional to have work areas divided up by interchangeable screens or dividers that extend part way to the ceiling. These screens and dividers are used to define different work areas, such as typing areas, conference areas, waiting areas, etc. The advantage of the interchangeable type of screens and dividers is that work areas may be redefined by relocation of screens. These relocations may be made without costly expenses of tearing down fixed dividing walls.

The known types of interchangeable room dividers used for dividing work areas are generally restricted by the size of the units, the flexibility of interlocking between the units, and the load bearing properties of the units. Thus, it is necessaryy to keep work area divisions within fixed limits, and avoid overloading units. Also, some of the existing types of screens have poor acoustical properties on account of flimsy transmission barrier allowing speech and other noises to be overheard between work areas.

The present invention provides a room divider panel assembly suitable for interchangeable installation which has a series of panel units, each unit being formed from a load bearing rectangular frame. In a preferred embodiment of the invention, the load bearing frame has a central barrier or septum which has an acoustical layer on each side and the whole frame is surrounded by a fabric layer in the form of a removable slip cover. Tubular legs are attached to the load bearing frame to support each panel unit.

The vertical side members and horizontal side members may be used to support shelves or coat racks. Furthermore, the members of the rectangular frame are hollow and capable of carrying electrical or telephone cables therein, referred to as wire management, to supply power and communications at required points anywhere within the screened area.

Link connecting means are provided accurately located at the axial centre of the top edge and the bottom edge of the vertical side members of a panel unit. Connecting links are provided between the link connecting means on adjacent panel units, and because of the accurate location of the link connecting means, the panel units are pivotable so that the angular relationship between any two panel units may be varied as desired. Furthermore, as many as four panel units may be connected together by connecting links, each extending from the link connecting means on adjacent panel units. In another embodiment, a sliding link connecting means may be positioned at any position along the top horizontal member of a panel unit such that two panel units may be joined by a connecting link in a T-configuration, instead of using three panel units.

The present invention provides a room divider panel unit comprising, a load bearing rectangular frame with a horizontal top member, horizontal bottom member and two vertical side members, all members having a common cross-section of hollow double channel press formed sheet steel, rigidly joined together, two vertical caps of semi-circular cross section, each of the vertical caps attached to opposite edges of the vertical side members, extending from a top edge to a bottom edge, link connecting means located at the semi-circular centre of the two vertical caps at the top edge and the bottom edge, and a pair of tubular legs adapted to support the panel unit, each leg extending downwards and connected inside to each of the two vertical side members.

In drawings which illustrate embodiments of the invention,

Figure 6:
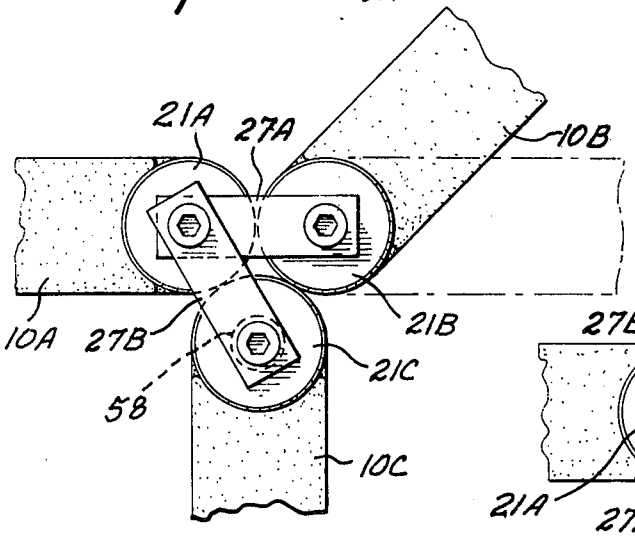

FIG. 6 on the second page of drawings is a top elevation showing the top edges of three panel units joined together with two connecting links.

Figure 7:
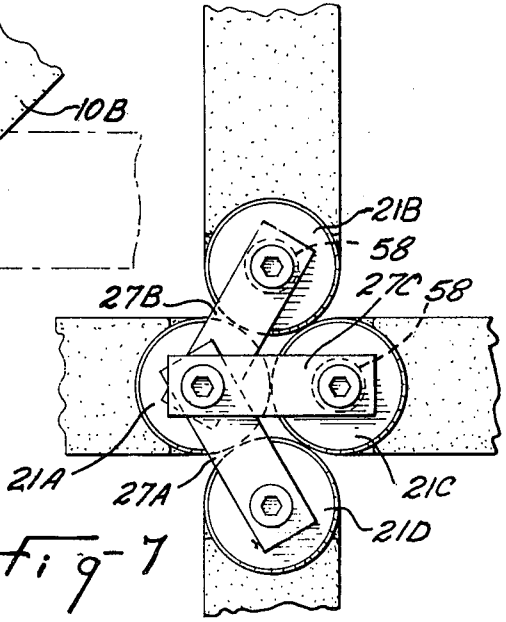
Figure 4:
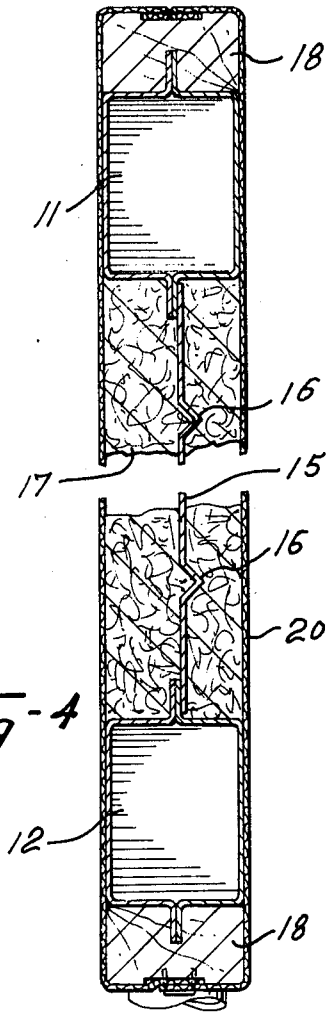
FIG. 4 is a sectional elevation taken at line 4—4 of FIG. 1.

FIG. 7 on the second page of drawings is a top elevation showing the top edges of four panel units joined together with three connecting links.

Figure 8:
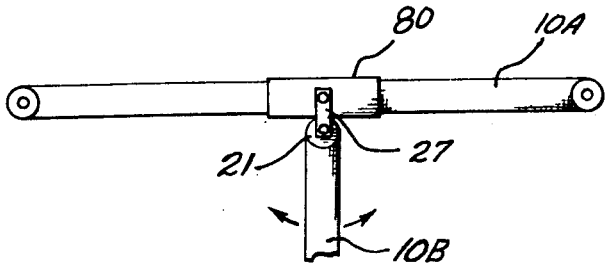

FIG. 8 on the third page of drawings is a top elevation showing the top edges of two panel units with an end of one panel unit joined to a location along the edge of another panel unit by a connecting link.

Figure 9:
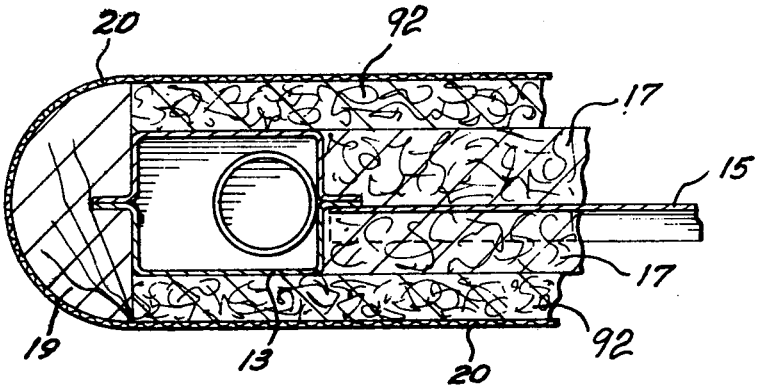
Figure 10:
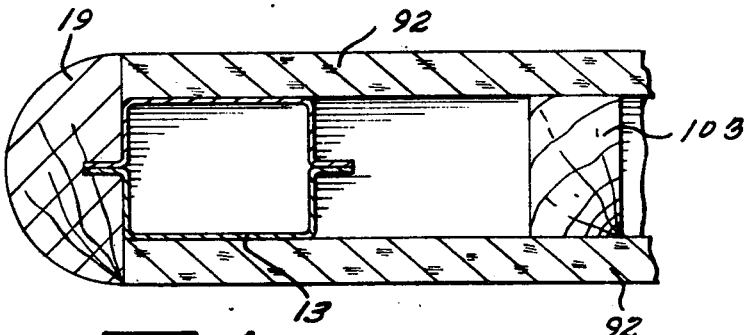
Figure 11:
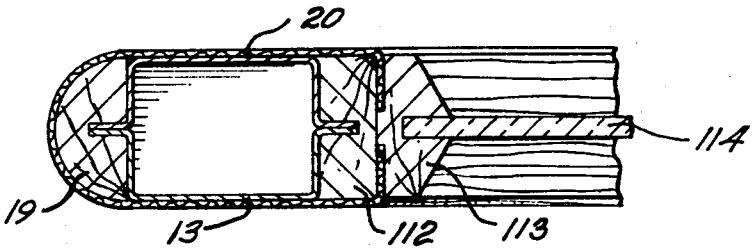

FIGS. 9, 10 and 11 are partial sectional plans of different embodiments of room divider panel units.

Referring to FIGS. 1 to 4, a panel unit 10 is shown with a load bearing rectangular frame having a horizontal top member 11, horizontal bottom member 12 and two vertical side members 13. All the members of the rectangular frame have the same cross section and are formed of two top hat channel sections with the brim flanges of each channel section secured together to form a hollow section therebetween. The top hat channel sections are all made of sheet steel and are formed on a press brake. Thus each top hat channel section is precision made and each bend line is straight and true in order to accurately locate the pivot point for the link connecting means. The brim flanges of the channel sections are spot welded together at spaced apart intervals to give the double channel section strength and rigidity. The four corners are spot welded rigidly together such that the two vertical side members 13 extend to the very top and bottom of the frame and are cut away at their sides to allow connection with the horizontal top member 11 and bottom member 12. The joint between the horizontal members and the vertical members is made by means of an insert plate 14 spot welded to the inside of each channel section.

When the panel has acoustic properties, a sheet metal barrier 15 or septum is attached by spot welding to the inside flanges of the double channel sections of the horizontal top member 11 and bottom member 12 and the two vertical side members 13. The barrier 15 has a series of horizontal ribs 16 therein which stiffen the barrier 15 and also prevent the insulating material 17 sliding down the barrier 15. The insulating material 17 is attached to the barrier 15 preferably by spray glueing, although other types of glueing are satisfactory as long as the insulating material 17 remains firmly attached to the barrier 15 and does not slip down leaving a gap at the top of the panel unit without insulation.

At the top and bottom edge of the panel unit 10, is a wooden horizontal cap 18, rectangular in cross section which has a groove in the center of one side to fit over the flange of the double channel section 11, 12. The horizontal cap 18 has a recess in the side opposite that containing the groove. This recess is used for attaching the fabric layer on the bottom of the panel unit. Each side edge of the panel unit 10 has a vertical cap 19 formed from wood and having a semi circular cross section. The vertical cap 19 has a groove in the center of its diameter which fits over the flange of the double channel section 13 and is preferably glued to the double channel section 13. Other means of fastening may be used. A fabric layer surrounds the panel and is formed as a slip cover 20 with one open end. This open end is closed on the underside of the horizontal cap 18 on the horizontal bottom member 12 by glueing or other suitable means such as staples. The slip cover 20 may be removed for cleaning and is replaceable in a different colour or composition if required.

Each corner of the panel unit 10 has a link connecting means 21 to allow panel units to be joined together. The link connecting means 21 includes a stud 22 which is accurately positioned in the exact centre of the panel and the semi-circular vertical cap 19, and is attached to the top and the bottom of the vertical side members 13. The stud 22 has an external thread 23 at its top to which is attached a circular disc 24 having a tapped hole at the centre thereof. The circular disc 24 fits on the outside of the slip cover 20 and has a knurled external rim for esthetic properties and to grip the disc 24 after the slip cover 20 is placed on the panel. The stud 22 also has a tapped hole 25 therein into which fits a socket head machine screw 26. The machine screw 26 holds a connecting link 27 to the circular disc 22. With connecting links 27 at top and bottom a strong rigid joint is formed between panel units. Furthermore, the accurate location of the stud 22 and the straight and true top hat channel sections ensure that the edges of adjacent panels touch throughout their length at all angles between the panels.

At the bottom corners of each panel unit, adjacent the connecting means 21 are tubular legs 28 which connect into the hollow double channel section of the two vertical side members 13. If a single panel unit is to be used then wide feet 29 are provided at the bottom of the tubular legs 28 to support the panel unit 10 and prevent tipping. If several panel units are to be joined together to form a panel unit assembly then the wide feet 29 are not necessary and the tubular legs 28 merely end in circular pads which sit on the floor.

Figure 5:
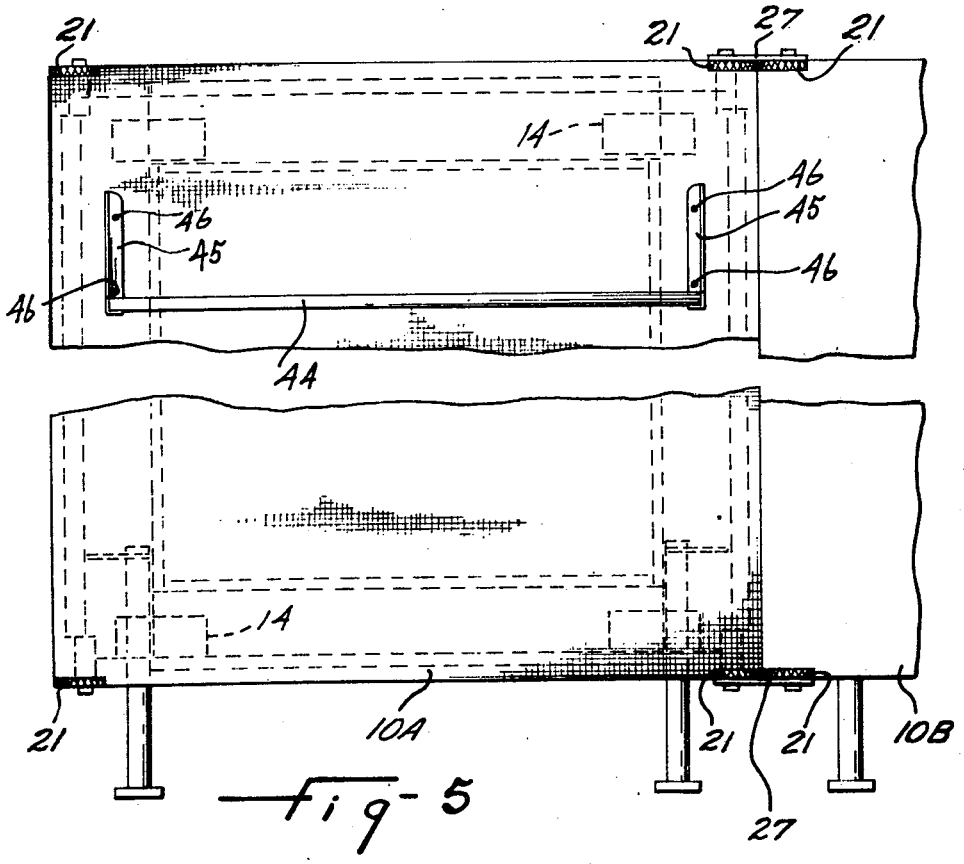
FIG. 5 is a side elevation of a panel unit similar to that shown in FIG. 1 joined to an adjacent panel unit by connecting links.

FIG. 5 shows an acoustical panel unit 10A joined to another unit 10B by link connecting means 21 and connecting links 27 at the top and bottom. A storage unit in the form of a sheet metal shelf 44 is shown supported by two sheet metal triangular brackets 45 which are attached to the vertical double channel sections of the panel by means of self-drilling screws 46. FIG. 6 shows a three screen assembly, the units being at any desired angle. The link connecting means 21A of the first panel 10A has a first connecting link 27A going to a link connecting means 21B of a second panel unit 10B. The link connecting means 21A of the first panel unit also has a second connecting link 27B joining to a link connecting means 21C of a third panel unit 10C. In this instance, a washer 58 is provided between the second connecting link 27B and the circular disc of the link connecting means 21C so that each of the connecting links are horizontal.

In FIG. 7 four panels are shown with three connecting links 27A, 27B and 27C joining the four link connecting means 21A, 24B, 21C and 21D. All three connecting links 27A, 27B and 27C are connected to a common link connecting means 21A. Connecting link 27A is the lowest link. Connecting link 27B is the middle link and requires one washer 58 on the link connecting means 21B. The highest connecting link 27C requires two washers 58 on the link connecting means 21C.

A sliding link connecting means 80 is shown in FIG. 8 joined to the top edge and bottom edge of a panel unit 10A. The sliding link connecting means may be positioned anywhere along the length of the panel unit 10A. A connecting link 27 perpendicular to the sliding link connecting means 80 joins a link connecting means 21 of a second panel unit 10B. The second panel unit 10B may be at any angle within 180° to the panel unit 10A. Sliding link connecting means are provided on the top edge and the bottom edge of the panel unit, and when the socket head screws 26 are tightened to hold the connecting links in place, sufficient pressure is developed to hold the sliding link connecting means securely in place on the panel unit.

Another embodiment of a panel unit is shown in FIG. 9 having the same structural frame as that shown in FIGS. 1, 2, 3 and 4. A vertical wooden cap 19 has a semi-circular cross section with a diameter greater than the width of the double channel section 13, and two further insulating layers 90, are provided one on each side of the initial insulating material 17 on each side of the barrier 15. The two further layer 90 extend to the vertical cap 19 and a fabric layer 20 surrounds the panel.

In FIG. 10 a vertical wooden cap 19 similar to that shown in FIG. 9 is attached to the double channel section 13 and has two external panels 92, one on each side which are attached to the outside of the double channel section 13 and form a smooth joint with the vertical cap 19. The external panels 92 may be corkboard, plasterboard or any suitable panel material desired. Wooden spacers 103 are located between the panels 92 to give rigidity to the unit which does not have any acoustic insulation therein.

Figures 1, 2:
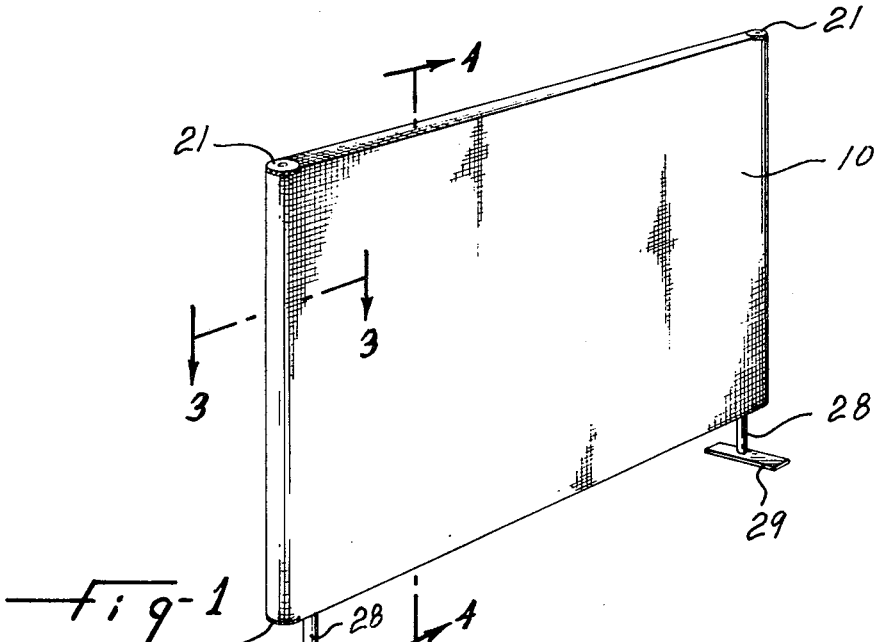
FIG. 1 is an isometric view of a room divider panel unit according to one embodiment of the present invention.
FIG. 2 is an isometric detail partially in section, of an upper corner of the panel unit shown in FIG. 1 showing a connecting link to join two panel units together.
Figure 3:
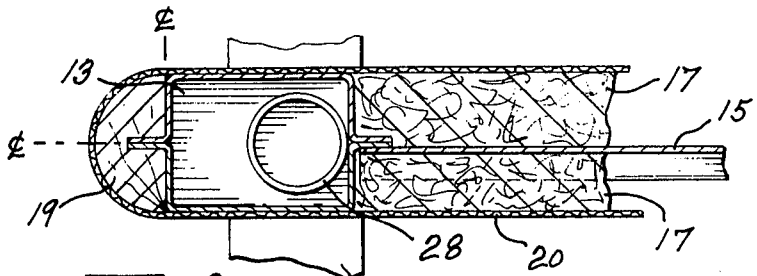
FIG. 3 is a sectional plan taken at line 3—3 of FIG. 1.

FIG. 11 shows a double channel section 13 having a vertical wooden cap 19 of the same size as that shown in FIG. 3. On the inside of the structural frame is an internal wooden cap 112 with a groove in the centre which fits over the flange of the double channel section 13. Inside the internal cap 112 is a window moulding 113 supporting a transparent panel 114, preferably made of clear plastic. A fabric layer 20 surrounds the vertical cap 19, the double channel section 13 and the internal cap 112. This panel unit is transparent but has link connecting means at top and bottom and thus fits together with all the panels illustrated in FIGS. 1 to 4.

Each connecting link is of a sufficient length so that the edge of the adjoining panels touch for their full length. Furthermore, because of the semi-circular cross section of the vertical caps of each panel, the angle between two or more panels may be varied as desired. Once the connecting link has been joined at two panel units, it is merely necessary to tighten the socket head machine screw 26 to the stud 22. This then rigidly holds the connecting link to the link connecting means and ensures there is no likelihood of the panel units moving.

The hollow double channel sections used in the frame provide conduits for electrical wires, telephone wires, etc. Outlets may be placed at strategic points and pipe conduits may be inserted within these double channel sections to give protection to electrical wires or communication wires and to keep them separate one from the other. Wire management may be designed to suit local codes. The double channel sections also provide a rigid support for attaching storage units such as shelves, coat racks, work tops, and the like. Other heavy equipment such as computer terminals or machine parts may also be attached or hooked into the double channel sections. These may be attached to the vertical side members by means of self-tapping or self-drilling screws by hooking into the double channel sections by means of slots and hooks, or other suitable metal to metal attachment means such as bolts through the section.

The vertical caps and horizontal caps while shown in the present embodiment being made of wood may be made of a flameproof or other suitable material. Furthermore, the fabric layer may be made of flame retardant material thus making the complete panel unit fireproof. Whereas in the preferred embodiment, the construction of the steel frame and barrier have been by means of spot welding, this could be replaced by self-tapping or self-drilling screws or other means of joining steel rigidly together. In a preferred embodiment of a panel unit, having acoustical properties, the barrier material is made from sheet steel weighting 10 ozs/sq.ft., the fiberglas on both sides of the barrier is 4 lbs/cu.ft. The rigidity of the steel frame allows panel units to be built to a height of seven feet and up to ten feet in length. Screens may be made curved, to suit space requirements. Furthermore, by having the swivel linkage system of connection the panel units may be positioned so that the angle between them varies slightly so the best angle is obtained for improved acoustical properties.

The embodiments of the invention in which an exclusive property or privilege is claimed are defined as follows.

1. A room divider panel unit comprising a load bearing rectangular frame with a horizontal top member, horizontal bottom member, and two vertical side members, all members having a common cross section of hollow double channel press formed sheet steel rigidly joined together, two vertical caps of semi-circular cross section, one of the vertical caps attached to an edge of one of the vertical side members and the other vertical cap attached to the other vertical side member, extending from a top edge to a bottom edge, link connecting means located at the semi-circular centre of the two vertical caps at the top edge and the bottom edge, and a pair of legs adapted to support the panel unit, both legs extending downwards and connected inside a respective vertical side member.

2. The panel unit according to claim 1 including a sheet steel barrier located within the frame connected at the mid-point of each member, and a pair of acoustical layers, each layer positioned on opposite sides of the barrier and adhering thereto.

3. The panel unit according to claim 2 wherein the sheet steel barrier has at least one horizontal rib extending between the two vertical side members.

4. The panel unit according to claim 2 including a fabric layer surrounding the frame and covering the acoustical layers.

5. The panel unit according to claim 3 wherein the link connecting means includs a circular disc having a tapped hole therein engaging a stud located at the semi-circular center of each of the two vertical caps, the disc secured to the vertical side members of the panel unit outside the fabric layer, the disc having a diameter substantially the same as the diameter of the semi-circular vertical cap, the stud having a tapped hole therein and a machine screw adapted to fit within the stud and clamp a connecting link rigidly to the circular disc.

6. The panel unit according to claim 1 including two horizontal caps of substantially rectangular cross section, one of the vertical caps attached to the top edge of the horizontal top member and the other to the bottom edge of the horizontal bottom member.

7. The panel unit according to claim 6 wherein the vertical caps and the horizontal caps are made of wood and wherein the fabric layer is in the form of a lip cover being attached only on the bottom edge of the bottom horizontal cap.

8. The panel unit according to claim 1 including a storage unit attached to the panel unit by attachment means to each of the two vertical side members.

9. The panel unit according to claim 8 wherein the attachment means are self-drilling screws.

10. A room divider panel assembly comprising at least two units having connecting links therebetween, each unit comprising:

(a) a load bearing rectangular frame with a horizontal top member, horizontal bottom member, and two vertical side members, all members having a common cross section of hollow double channel pressed formed sheet steel, rigidly joined together, (b) two vertical caps of semi-circular cross section one of the caps attached to an outer edge of one of the vertical side members and the other vertical cap attached to the other vertical side member, the caps extending from a top edge of a bottom edge of the panel unit, (c) a pair of tubular legs adapted to support the panel unit, both legs extending downwards and connected inside a respective vertical side member, and (d) link connecting means at the top edge and the bottom edge of the panel unit positioned at the semi-circular centre of each of the two vertical caps, and connecting links each extending from the link connecting means on one panel to the link connecting means on an adjacent panel, the connecting link having a length substantially equal to the diameter of the semi-circular vertical caps, such that the vertical caps of adjacent panels are touching, each panel having rotatable about the semi-circular centre of each of the two vertical caps, and including clamping means to clamp the link connecting means and the connecting link rigidly together.

11. The panel assembly according to claim 8 including a sheet metal barrier located within the frame connected at the mid-point of each member, and a pair of acoustical layers, each layer positioned on opposite sides of the barrier and adhering thereto.

* * * * *